US009414168B2

(12) United States Patent
Sacha et al.

(10) Patent No.: US 9,414,168 B2
(45) Date of Patent: Aug. 9, 2016

(54) MAGNETOMETER IN HEARING AID

(71) Applicant: Starkey Laboratories, Inc., Eden Prairie, MN (US)

(72) Inventors: Michael Karl Sacha, Chanhassen, MN (US); Yezihalem Mesfin, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/227,948

(22) Filed: Mar. 27, 2014

(65) Prior Publication Data

US 2015/0281852 A1 Oct. 1, 2015

(51) Int. Cl.
*H04R 25/00* (2006.01)

(52) U.S. Cl.
CPC ..... *H04R 25/30* (2013.01); *H04R 25/00* (2013.01); *H04R 25/43* (2013.01); *H04R 25/554* (2013.01); *H04R 25/40* (2013.01); *H04R 25/552* (2013.01); *H04R 2225/61* (2013.01)

(58) Field of Classification Search
USPC ..... 381/312, 315, 331, 314
See application file for complete search history.

(56) References Cited

U.S. PATENT DOCUMENTS 5,600,728 A * 2/1997 Satre ..... H04R 25/505 381/123
5,642,045 A * 6/1997 Keefe ..... G01R 33/022 324/225
7,397,926 B1 * 7/2008 Frerking ..... H04M 1/6066 381/315
2004/0125972 A1 * 7/2004 Boor ..... H04R 25/502 381/312
2005/0012745 A1 * 1/2005 Kondo ..... G06T 3/0062 345/427
2008/0037810 A1 * 2/2008 Lotter ..... H04R 25/554 381/312
2008/0075306 A1 * 3/2008 Poulsen ..... H04R 19/005 381/111
2010/0142738 A1 * 6/2010 Zhang ..... H04R 25/558 381/315
2013/0216075 A1 8/2013 Sacha et al.
2014/0185845 A1 * 7/2014 Udesen ..... H04R 25/554 381/313
2015/0181355 A1 * 6/2015 Pedersen ..... H04R 25/552 381/313

FOREIGN PATENT DOCUMENTS

DE 20114461 U1 10/2001

OTHER PUBLICATIONS

"Application Note—AN218 Vehicle Detection Using AMR Sensors", Honeywell International Inc., (Aug. 2005), 10 pgs.
"European Application Serial No. 15161476.5, Extended European Search Report mailed Jul. 28, 2015", 8 pgs.

* cited by examiner

*Primary Examiner* — Amir Etesam
(74) *Attorney, Agent, or Firm* — Schwegman Lundberg & Woessner, P.A.

(57) ABSTRACT

Described herein are methods and devices that use magnetometer in a hearing aid for measuring a magnetic field. The magnetometer may be a high-sensitivity triaxial magnetometer that detects the magnetic field in three orthogonally oriented directions. Such a magnetometer may be placed in the hearing aid without restriction as to location or orientation. The measured magnetic field may be used for telecoil switching when the presence of a magnetic field produced by a speaker or other source is detected. The measured magnetic field may also be used for magnetic mapping of the environment and motion detection.

20 Claims, 2 Drawing Sheets

MAGNETOMETER IN HEARING AID

FIELD OF THE INVENTION

This invention pertains to electronic hearing aids and methods for their use.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. Hearing aids may also be equipped with a telecoil. A telecoil (also referred to as a T-coil for "telephone coil") is a small device installed in a hearing aid that detects the electromagnetic field generated by audio induction loops such as the speaker of a telephone handset. The signal detected by the T-coil is processed and converted to an acoustic signal by the speaker. When the hearing aid is in the telecoil mode, the processing of the T-coil signal may be performed in place of, or in addition to, processing of the microphone signal to generate sound for the hearing aid wearer.

DETAILED DESCRIPTION

Described herein are methods and devices that use magnetometer in a hearing aid for measuring a magnetic field. The magnetometer may be a high-sensitivity triaxial magnetometer that detects the magnetic field in three orthogonally oriented directions. Such a magnetometer may be placed in the hearing aid without restriction as to location or orientation. The measured magnetic field may be used for telecoil switching when the presence of a magnetic field produced by a speaker or other source is detected. The measured magnetic field may also be used for magnetic mapping of the environment and motion detection.

Figure 1:
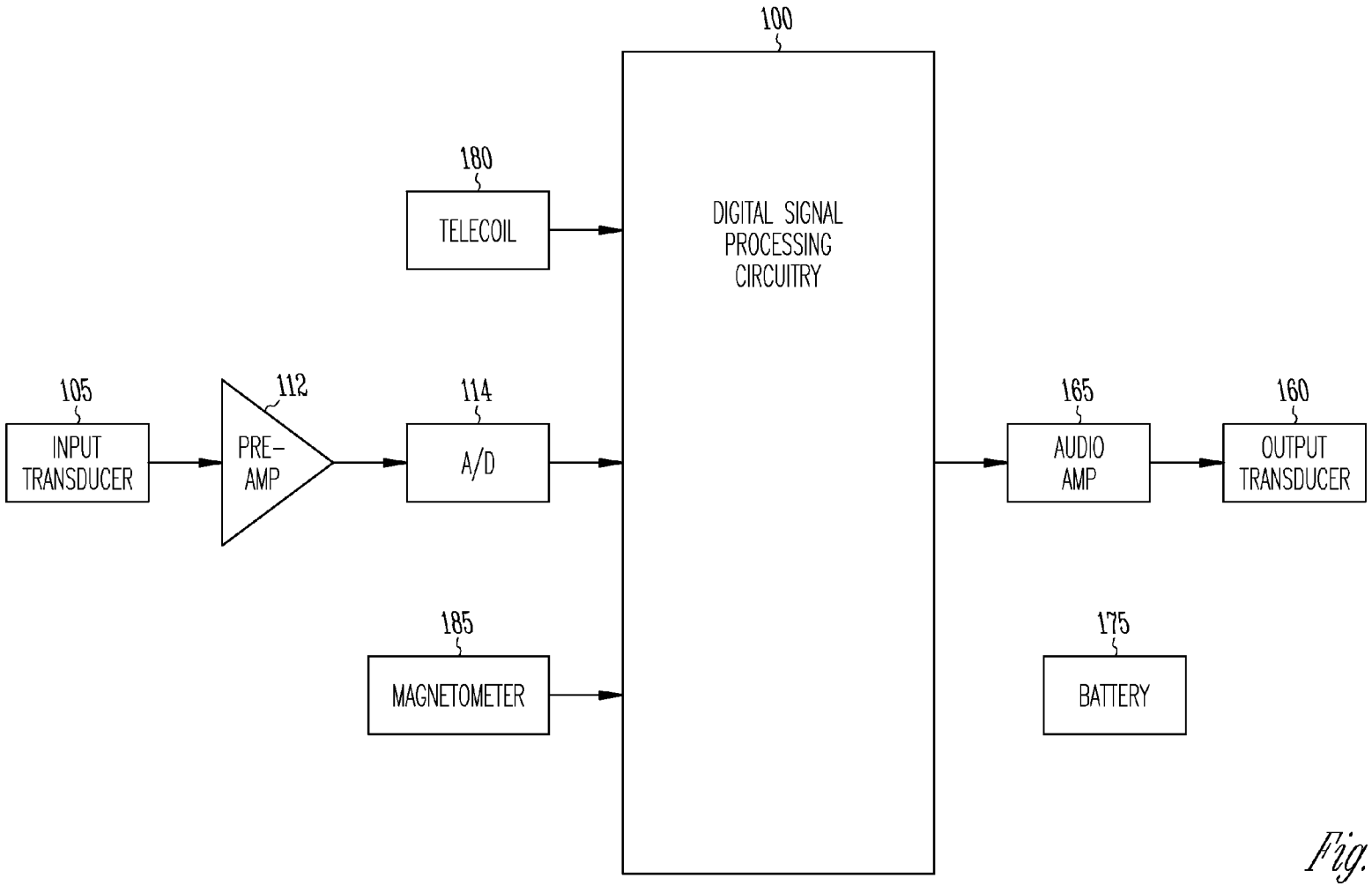
FIG. 1 shows the basic electronic components of an example hearing aid.

FIG. 1 illustrates the basic functional components of an example hearing aid. The electronic circuitry of the hearing aid is contained within a housing that may be placed, for example, in the external ear canal or behind the ear. A microphone 105 receives sound waves from the environment and converts the sound into an input signal. After amplification by pre-amplifier 112, the input signal is sampled and digitized by A/D converter 114 to result in a digitized input signal. The device's digital signal processing (DSP) circuitry 100 processes the digitized input signal into an output signal in a manner that compensates for the patient's hearing deficit. The output signal is then passed to an audio amplifier 165 that drives the receiver or speaker 160 to convert the output signal into an audio output. A battery 175 supplies power for the electronic components.

The processing circuitry 100 may be implemented in a variety of different ways, such as with an integrated digital signal processor or with a mixture of discrete analog and digital components. For example, the signal processing may be performed by a mixture of analog and digital components having inputs that are controllable by the controller that define how the input signal is processed, or the signal processing functions may be implemented solely as code executed by the controller. The terms "controller," "module," or "circuitry" as used herein should therefore be taken to encompass either discrete circuit elements or a processor executing programmed instructions contained in a processor-readable storage medium.

Also shown in FIG. 1 is a telecoil 180 that detects the electromagnetic field generated by audio induction loops such as the speaker of a telephone handset. The signal from the telecoil is digitized and fed to the DSP 100 where it is used in place of, or in addition to, the microphone signal to generate the audio output for the hearing aid wearer when the hearing aid is operating in a telecoil mode. The telecoil mode may be activated manually via a user input or may be activated automatically when the presence of a magnetic field produced by the magnet of a telephone speaker is sensed. For this purpose, a triaxial magnetometer 185 for detecting the magnitude of a magnetic field is connected to the DSP 100. A triaxial magnetometer senses the magnitude of a magnetic field in any direction and thus eliminates the need for the magnetometer to be placed in the hearing aid with some specific orientation.

Figure 2:
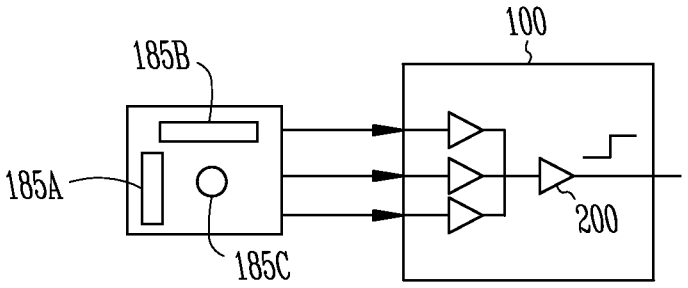
FIG. 2 shows the interfacing between a triaxial magnetometer and a digital signal processor according to one embodiment.
Figure 3:
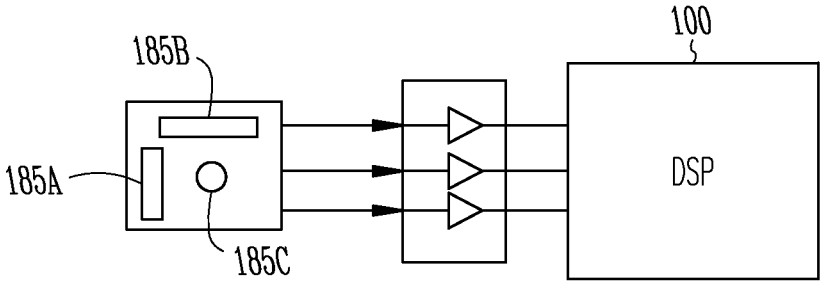
FIG. 3 shows the interfacing between a triaxial magnetometer and a digital signal processor according to one embodiment.
Figure 4:
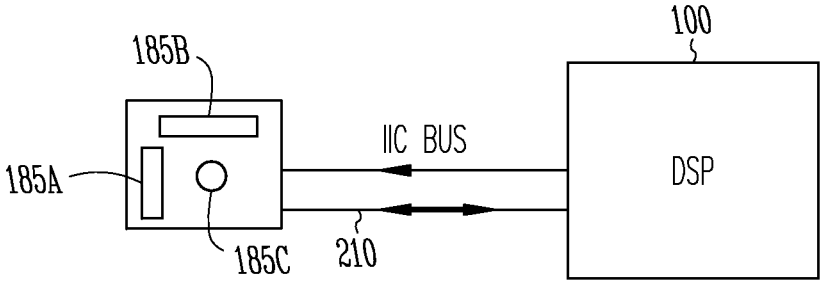
FIG. 4 shows the interfacing between a triaxial magnetometer and a digital signal processor according to one embodiment.

FIGS. 2 through 4 illustrate ways that the triaxial magnetometer 185 may be interfaced to the DSP 100 in various embodiments. In FIG. 2, the triaxial magnetometer 185 comprises three orthogonally oriented sensor elements 185*a* through 185*c* whose outputs are summed by a buffer amplifier 200 and then input to the DSP 100. In FIG. 3, the triaxial magnetometer 185 comprises three orthogonally oriented sensor elements 185*a* through 185*c* whose outputs are individually input to the DSP 100. In FIG. 3, the triaxial magnetometer 185 comprises three orthogonally oriented sensor elements 185*a* through 185*c* whose outputs are input to the DSP 100 via an inter-integrated circuit (IIC) bus 210.

A conventional GMR (gigantic magnetoresistance) or Hall-effect magnetometer typically can only sense magnetic fields greater than 10 Gauss. Using such a magnetometer for telecoil mode switching necessitates that the magnetometer be placed in the hearing aid near the face plate that faces outwardly from the ear so as to be nearer the magnetic field source. In order to provide increased sensitivity, the triaxial magnetometer 185 may also be designed with a sensitivity for detecting a magnetic field as small as 0.6 Gauss (i.e., corresponding to the Earth's magnetic field). Such a sensitivity would allow the magnetometer to be placed further back in the hearing aid housing away from the face plate and still able to performing its switching function when a telephone handset is held near the wearer's ear. Eliminating placement restriction imposed by less sensitive magnetometers makes manufacturing easier. In order to provide this increased sensitivity, the triaxial magnetometer may comprise three orthogonally oriented sensor elements of a type selected from a group that includes: anisotropic magnetoresistance (AMR), tunnel magnetoresistance (TMR), and colossal magnetoresistance (CMR).

Thus, a triaxial magnetometer with an increased sensitivity as described above can be placed virtually anywhere within a hearing aid with no orientation or placement requirements. The increased sensitivity removes the constraint of having to locate the sensor on the face plate, and the multi-axis sensing removes any orientation constraints. During assembly, the magnetometer can then be placed to fit the limited space available in an aid.

Also, in a RIC (receiver-in-canal) hearing aid design that places the receiver, telecoil and magnetometer in the receiver module which is then placed in the ear canal, connection wires are needed to connect these components to a hearing aid circuit that includes the DSP within the device housing that is placed outside the ear. One of the components that needs these connection wires is the magnetic sensor. With the sensitivity provided by a GMR/Hall-effect type of magnetometer, this sensor has to be placed in close proximity to the telecoil in the receiver module because it doesn't have enough sensitivity to sense the phone's magnetic field from within the RIC's shell. As result of this, more connection wires are used up leaving no more signal interface for future expansion. If the sensitivity of the magnetometer is increased as described above, the magneometer can be located within the device housing instead of the receiver module so that fewer connection wires need to be used and so that such connection wires can be used for other purposes.

*Other Embodiments*

If the triaxial magnetometer is placed in a known orientation within the hearing aid, then the sensor elements of the magnetometer may be used for magnetically based navigation. For example, the DSP may be programmed to use the magnetometer signals to allow one to magnetically map the interior of buildings when GPS signals are lost. Such a feature in a hearing aid may assist a user in navigating around his/her home in dim lit conditions or in locating a favorite chair where typically the user would switch into TV streaming mode. The magnetometer signals may also be used by the DSP determine if a user is in a car and to switch the hearing aid into a mode of operation that is suitable in such noisy, reverberant environments. As a person approaches a car and enters, a unique magnetic signature will result. The presence of a car, a large ferrous object, will distort the earth's field around car.

In another embodiment, the triaxial magnetic sensor may be used as an alternative method for automatically turning a hearing aid on or off or as a secondary confirmation to a primary on/off sensor resulting in a more robust determination of state. This could be accomplished by having the DSP use the magnetometer signals to track the hearing aid's movement through earth's magnetic field in space as aid is inserted or removed from ear. In one embodiment, first and second hearing aids are worn by a wearer. Each of the hearing aids is equipped with a triaxial magnetometer as described herein.

The two hearing aids working together are then able to detect relative movement between each other to sense a hearing aid being placed in or being removed from an ear (auto on/off). When the movement of both hearing aids are synched then the hearing aids are most likely in/on a person's ear, and aid they are turned on. When a non-synched condition is detected, then one hearing aid is being removed or falling off user's ear, and appropriate actions can be taken such as turning the hearing aid off or placing the hearing aid in a feedback mode so user may hear their hearing aid and retrieve it.

In another embodiment, the triaxial magnetometer may provide an anti-theft feature. The DSP is programmed to use the magnetometer signals to detect a unique motion performed by the wearer with the hearing aid. When the unique motion is detected, the DSP may then to turn a the hearing aid on, or alternatively, to enable the hearing aid to be turned on with another user input.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A hearing aid, comprising:

a microphone for converting an audio input into a first input signal;

telecoil for converting a time-varying electromagnetic field sensed by the telecoil into a second input signal;

a digital signal processor (DSP) for processing the first input signal, the second input signal, or a combination thereof into an output signal in a manner that compensates for the patient's hearing deficit;

an audio amplifier and speaker for converting the output signal into an audio output;

a triaxial magnetometer for measuring a magnetic field produced by a magnet along three orthogonal axes and sending signals corresponding thereto to the DSP;

wherein the DSP is configured to use the second input signal generated by the telecoil for producing the output signal when a magnetic field above a specified threshold is measured by the triaxial magnetometer; and, wherein the DSP is configured to detect the presence of objects in the environment of a wearer of the hearing aid that distort the Earth's magnetic field as measured by the triaxial magnetometer.

2. The hearing aid of claim 1 wherein the triaxial magnetometer comprises three orthogonally oriented sensor elements whose outputs are summed by a buffer amplifier and then input to the DSP.

3. The hearing aid of claim 1 wherein the triaxial magnetometer comprises three orthogonally oriented sensor elements whose outputs are individually input to the DSP.

4. The hearing aid of claim 1 wherein the triaxial magnetometer comprises three orthogonally oriented sensor elements whose outputs are input to the DSP via an inter-integrated circuit (IIC) bus.

5. The hearing aid of claim 1 wherein the triaxial magnetometer comprises three orthogonally oriented sensor elements capable of sensing a magnetic field having a magnitude of 0.6 Gauss or greater.

6. The hearing aid of claim 1 wherein the triaxial magnetometer comprises three orthogonally oriented sensor elements of a type selected from a group that includes: anisotropic magnetoresistance (AMR), tunnel magnetoresistance (TMR), and colossal magnetoresistance (CMR).

7. The hearing aid of claim 1 wherein the DSP is programmed to use the signals from the triaxial magnetometer that measure the Earth's magnetic field to magnetically map the area where a wearer of the hearing aid is located.

8. The hearing aid of claim 1 wherein the DSP is programmed to use the signals from the triaxial magnetometer that measure the Earth's magnetic field to detect when a wearer is inside an automobile.

9. The hearing aid of claim 1 wherein the DSP is programmed to use the signals from the triaxial magnetometer that measure the Earth's magnetic field to detect the relative position of a second hearing aid worn by a wearer of the hearing aid and to automatically turn the hearing aid off when it is determined that the hearing aids are not being worn.

10. The hearing aid of claim 1 wherein the DSP is programmed to use the signals from the triaxial magnetometer that measure the Earth's magnetic field to detect a unique motion of a wearer holding the hearing aid to enable the hearing aid to be turned on.

11. A method for operating a hearing aid, comprising:

converting an audio input into a first input signal;

converting a time-varying electromagnetic field sensed by a telecoil into a second input signal;

processing the first input signal, the second input signal; or a combination thereof into an output signal in a manner that compensates for a patient's hearing deficit;

converting the output signal into an audio output;

measuring a magnetic field produced by a magnet along three orthogonal axes and sending signals corresponding thereto to the DSP;

using the second input signal generated by the telecoil for producing the output signal when a magnetic field above a specified threshold as measured by the triaxial magnetometer; and, measuring the Earth's magnetic field and detecting the presence of objects in the environment of a wearer of the hearing aid that distort the Earth's magnetic field.

12. The method of claim 11 further comprising measuring the magnetic field with a triaxial magnetometer having three orthogonally oriented sensor elements whose outputs are summed by a buffer amplifier and then input to the DSP.

13. The method of claim 11 further comprising measuring the magnetic field with a triaxial magnetometer having three orthogonally oriented sensor elements whose outputs are individually input to the DSP.

14. The method of claim 11 further comprising measuring the magnetic field with a triaxial magnetometer having three orthogonally oriented sensor elements whose outputs are input to the DSP via an inter-integrated circuit (IIC) bus.

15. The method of claim 11 further comprising measuring the magnetic field with a triaxial magnetometer having three orthogonally oriented sensor elements capable of sensing a magnetic field having a magnitude of 0.6 Gauss or greater.

16. The method of claim 11 further comprising measuring the magnetic field with a triaxial magnetometer having three orthogonally oriented sensor elements of a type selected from a group that includes: anisotropic magnetoresistance (AMR), tunnel magnetoresistance (TMR), and colossal magnetoresistance (CMR).

17. The method of claim 11 further comprising using the magnetic field measurements of the Earth's magnetic field to magnetically map the area where a wearer of the hearing aid is located.

18. The method of claim 11 further comprising using the magnetic field measurements of the Earth's magnetic field to detect when a wearer is inside an automobile.

19. The method of claim 11 further comprising using the magnetic field measurements of the Earth's magnetic field to detect the relative position of a second hearing aid worn by a wearer of the hearing aid and to automatically turn the hearing aid off when it is determined that the hearing aids are not being worn.

20. The method of claim 11 further comprising using the magnetic field measurements of the Earth's magnetic field to detect a unique motion of a wearer holding the hearing aid to enable the hearing aid to be turned on.

* * * * *